United States Patent [19]

Alessio

[11] 4,184,667

[45] Jan. 22, 1980

[54] WORKPIECE SUPPORTING AND CLAMPING ARRANGEMENT

[75] Inventor: Lorenzo E. Alessio, Cairoli, Italy

[73] Assignee: Black & Decker Inc., Newark, Del.

[21] Appl. No.: 880,249

[22] Filed: Feb. 22, 1978

[51] Int. Cl.[2] ..... B25B 1/04

[52] U.S. Cl. ..... 269/139; 269/154; 269/239

[58] Field of Search ..... 125/35; 269/104–107, 269/110, 152–156, 139, 239, 79, 81, 237

[56] References Cited

U.S. PATENT DOCUMENTS

| | | | |
|---|---|---|---|
| 1,859,920 | 5/1932 | Haskins | 269/239 |
| 2,502,784 | 4/1950 | Fahlander | 269/139 |
| 3,615,087 | 10/1971 | Hickman | 269/139 |
| 4,054,279 | 10/1977 | Wain | 269/239 |

FOREIGN PATENT DOCUMENTS 1287657 2/1962 France .

*Primary Examiner*—Robert C. Watson
*Attorney, Agent, or Firm*—Walter Ottesen; Leonard Bloom; Edward D. Murphy

[57] ABSTRACT

A workpiece supporting and clamping arrangement includes supporting structure defining a supporting surface. A first top member having an upper surface is supported by the supporting structure on the supporting surface. A second top member likewise has an upper surface and both upper surfaces lie in a substantially horizontal plane. The top members also have respective mutually adjacent side walls defining clamping surfaces. A guiding structure is provided for guiding the second top member relative to the supporting structure. The second top member can be moved along the guiding structure so as to adjust the position of the second top member with respect to the first top member. The guiding structure is pivotally mounted so that the second top member can be rotated from a first position on the supporting surface whereat the upper surfaces of the top members are in the same horizontal plane to a second position whereat the second top member is in a plane transverse to said horizontal plane so as to cause the clamping surfaces and the supporting surface to conjointly define a three point clamping system. In the first position, the clamping arrangement is suited for clamping workpieces having two surfaces that are substantially parallel to each other; whereas, in the second position, the clamping arrangement is especially suited to clamping workpieces having a cylindrical or polygonal shape such as, for example, a section of tubular conduit.

28 Claims, 25 Drawing Figures

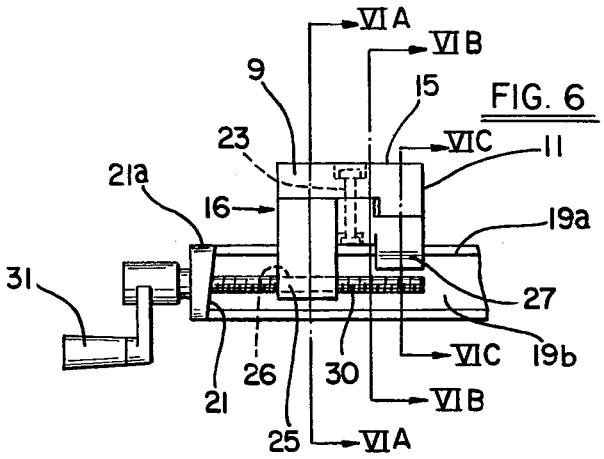
FIG. 6
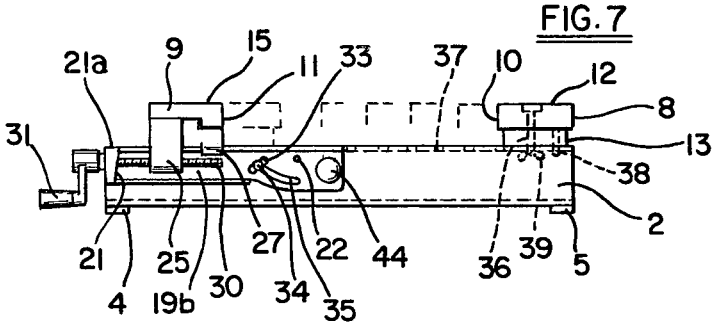
FIG. 7
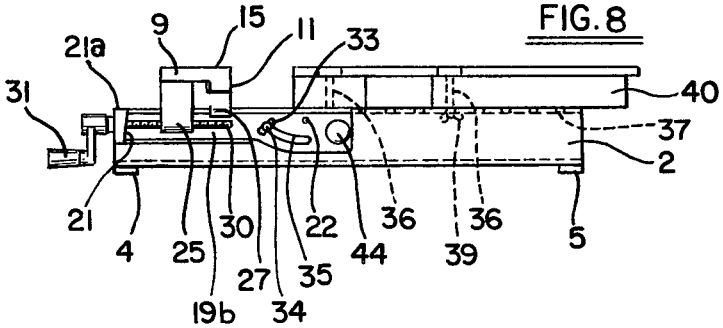
FIG. 8
FIG. 6A
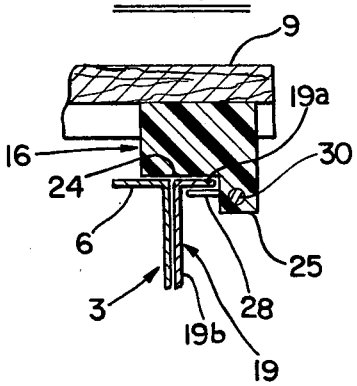
FIG. 6B
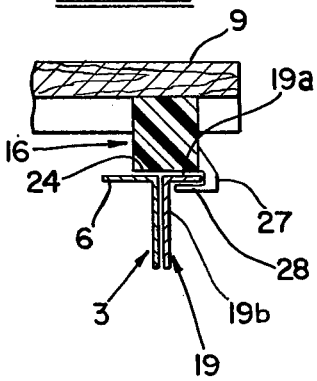
FIG. 6C
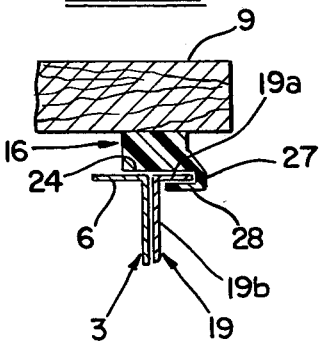

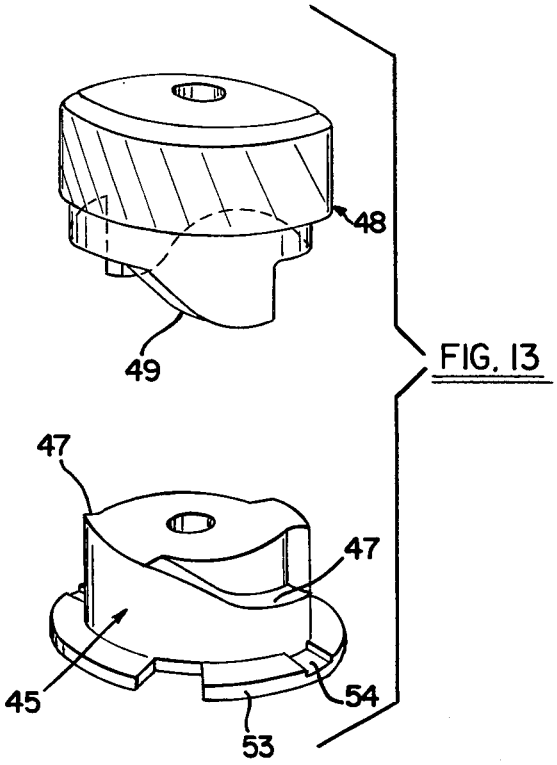
FIG. 13
FIG. 12
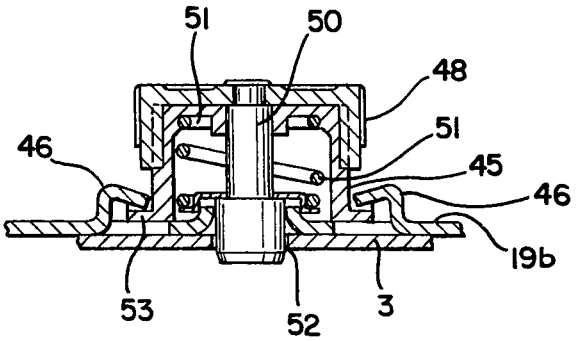

WORKPIECE SUPPORTING AND CLAMPING ARRANGEMENT

BACKGROUND OF THE INVENTION

The invention relates to a workpiece supporting and clamping assembly including at least two top members supported on a supporting structure. One of the top members can be rotated through an angle and moved against the workpiece in a plane defining an angle with respect to the supporting structure to thereby cause the top members and the supporting structure to conjointly define three point clamping system. Depending on the angular position of the one top member, the clamping assembly is suitable for clamping workpieces having various shapes including those of cylindrical or polygonal configuration.

Up to the present time, the general configuration of the workpiece has dictated to the operator which vise is to be used for clamping the workpiece. For example, vises are known wherein a fixed jaw and a movable jaw are both members having a flat and elongated configuration carried on a supporting structure having legs. The movable jaw can be moved away from and toward the fixed jaw by means of threaded spindles. actuated manually by means of a crank. The angular adjustment of these jaws is always made in the same horizontal plane conjointly defined by the upper surfaces of the two jaws. The workpiece can then be clamped only between the mutually adjacent vertical clamping surfaces defined by the two jaws.

This is a limitation and frequently prevents an operator from working on the workpiece in its most favorable position and in some cases prevents the operator from working with the vise altogether. Often an operator must do work on a workpiece of cylindrical or some other shape as opposed to workpieces which are of square or rectangular section. For clamping such a workpiece effectively, it is necessary that the workpiece be held at least at three points about its periphery. With regard to tubular conduit for example, the operator would normally reach for a special vise having V-shaped grooves in each of its clamping jaws so that the workpiece would be held at four locations about its periphery. Thus, it becomes apparent that the operator would have to have at least two vises in order to perform work in most situations. Even at that, however, the operator could not necessarily work on a workpiece in the most desirable position. Often, it is desirable to be able to clamp a workpiece down on a horizontal work surface so that operations such as planing or routing can be performed.

Another type of vise has been suggested in French Pat. No. 1,287,657 to Travers, wherein a workpiece can be clamped to either of two clamping surfaces of a first clamping jaw of a vise having two clamping jaws. The first clamping jaw can be clamped to the top of a table so as to be held in a substantially horizontal plane so that one of its clamping surfaces is in a vertical plane and its other clamping surface is in the horizontal plane. The second clamping jaw has one clamping surface and is pivotally mounted to the first clamping jaw with the aid of two threaded rods and is rotatable between two positions ninety degrees apart. The threaded rods are pivotally mounted in recesses of the first jaw. The French patent teaches that the clamping jaws can be used to clamp a workpiece in either of two positions, namely, when the second jaw is in a first position wherein the clamping surface of the second jaw is in the vertical position and in a second position wherein the clamping surface of the second jaw is horizontal and parallel to the horizontal clamping surface of the first jaw.

Although with this vise the operator has the capability of clamping a workpiece to a horizontal work surface the operator cannot clamp a workpiece of, say, tubular configuration because for each of the two positions, there are only two clamping surfaces. As mentioned above, to hold a workpiece of tubular configuration effectively requires at least three clamping surfaces. Therefore, even if the operator has a vise of the type taught by Travers, the operator would still need an additional vise such as a pipe vise.

Another disadvantage of the vise of the type disclosed in the French patent is that long workpieces of rectangular section cannot be effectively held down upon the clamping surfaces of the first clamping jaw since such a workpiece can only be inserted between the clamping surfaces of the two jaws to the depth of the threaded rods which pass through the longitudinal center of the second jaw. When clamping the workpiece, a turning moment is developed which causes the second jaw to slip off of the workpiece.

SUMMARY OF THE INVENTION

It would indeed be desirable to have a clamping arrangement which permits clamping a workpiece between clamping members in a horizontal position and also affords the capability of positioning one of the clamping members at an angle with respect to the other clamping member so that the same clamping arrangement can accommodate all workpieces irrespective of the workpiece configuration.

Also, it would be helpful if the same clamping arrangement can firmly hold a long workpiece down upon the top surface of the other one of the clamping members without the one clamping member slipping off of the workpiece when the clamping arrangement is tightened.

Accordingly, it is an object of my invention to obviate the above disadvantages of the prior art vises and provide a workpiece supporting and clamping arrangement which can accommodate workpieces of different shapes and configurations. More specifically, it is an object of my invention to provide a clamping arrangement wherein a three point clamping system is provided when desired so that workpieces having a cylindrical or polygonal configuration can also be clamped.

In addition to all the foregoing, it is desirable to provide a clamping arrangement which can perform all the above functions and yet also be capable of shaping workpieces having a planar configuration.

Therefore, it is still a further object of my invention to provide a workpiece and clamping arrangement wherein workpieces having a planar configuration such as sheetmetal can be shaped.

The workpiece supporting and clamping arrangement according to my invention includes a supporting structure defining surface support means. A first top member having an upper surface is supported by the supporting structure on the surface support means thereof. A second member likewise having an upper surface is provided and the upper surfaces of the two top members lie in a common substantially horizontal plane. The top members have respective mutually adjacent side walls which define clamping surfaces. Guiding means are provided for guiding the second top member relative to the supporting structure and means for moving the second top member along the guiding means adjusts the position of the second top member with respect to the first top member. Rotation means are provided for conjointly rotating the guiding means and the second top member from a first position on the surface support means to a second position whereat the second top member is in a plane transverse to the above-mentioned horizontal plane so as to cause the clamping surfaces and the surface support means to conjointly define a three point clamping system.

The workpiece supporting and clamping arrangement of my invention is suitable for mounting on a table top and, according to a preferred embodiment, the unit can include moving means including first and second clamping means interconnected between the guiding means and the second top member for moving the second top member over the guide means in a direction toward or away from the first top member for tightly holding a workpiece between the top members when the second top member is in the first position and between the top members and the surface support means when the second top member is at the second position. The first clamping means and the second clamping means are connected to the guide means and the second top member so as to be capable of being operated independently of each other whereby the width of the clamping gap between the top members can be adjusted to be greater at one longitudinal end of the gap than at the other longitudinal end of the gap.

In an alternate embodiment of my invention, a vise for clamping a workpiece includes a base and a first jaw supported by the base. A second jaw is provided and both jaws have respective mutually adjacent clamping surfaces. Guiding means guide the second jaw relative to the base and moving means move the second jaw along the guiding means so as to adjust the position of the second jaw with respect to the first jaw. The guiding means and the second jaw are rotatable through an angle from a first position whereat the clamping surfaces conjointly define a two point clamping system to a second position whereat the clamping surfaces and the base conjointly define a three point clamping system.

In this alternate embodiment, the moving means can preferably include a threaded spindle rotatably mounted on the guiding means; and, an internal thread formed in the second jaw threadably engaging the threaded spindle.

BRIEF DESCRIPTION OF THE DRAWING

The foregoing objects and advantages of my invention will become more apparent from a consideration of the detailed description to follow in conjunction with the drawings annexed hereto wherein:

FIG. 6 illustrates details of the mounting of the spacer support on the bracket pivotally mounted on the supporting structure;

FIG. 6A is a section view taken along line VIA—VIA of FIG. 6;

FIG. 6B is a section view taken along line VIB—VIB of FIG. 6;

FIG. 6C is a section view taken along line VIC—VIC of FIG. 6;

FIG. 7 is a side elevation view of the clamping arrangement of FIGS. 1 to 6 showing how one of the top members can be positioned to various locations on the supporting structure with respect to the other one of the top members.

FIG. 8 is an elevation view of the clamping arrangement wherein the right hand top member has been substituted by a third top member having a very large surface area;

FIG. 12 is a schematic diagram of the locking knob assembly for fixing the angular position of the guiding means at predetermined positions most often used when working with the clamping arrangement;

FIG. 13 shows details of two parts of the knob assembly of FIG. 12;

DESCRIPTION OF THE PREFERRED EMBODIMENTS OF THE INVENTION

Figure 1:
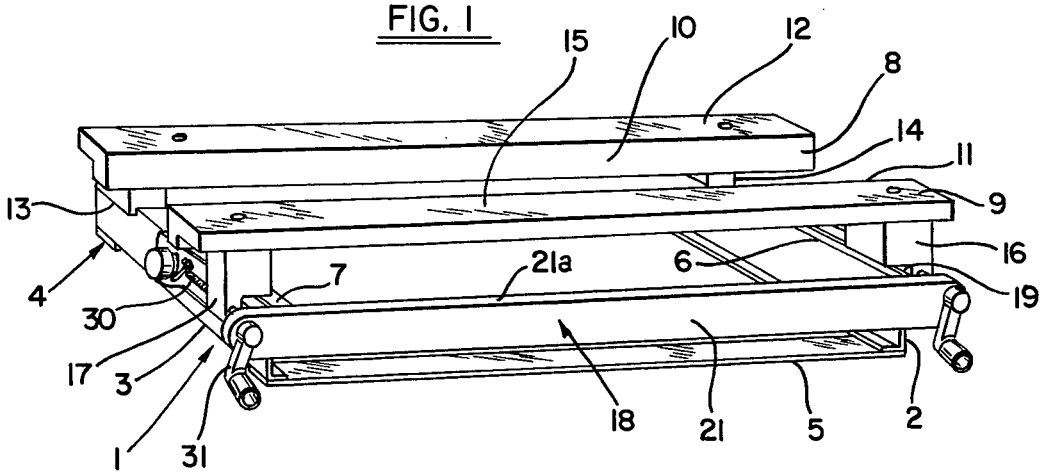
FIG. 1 is a perspective view of the workpiece supporting and clamping arrangement according to one embodiment of my invention.
Figure 2:
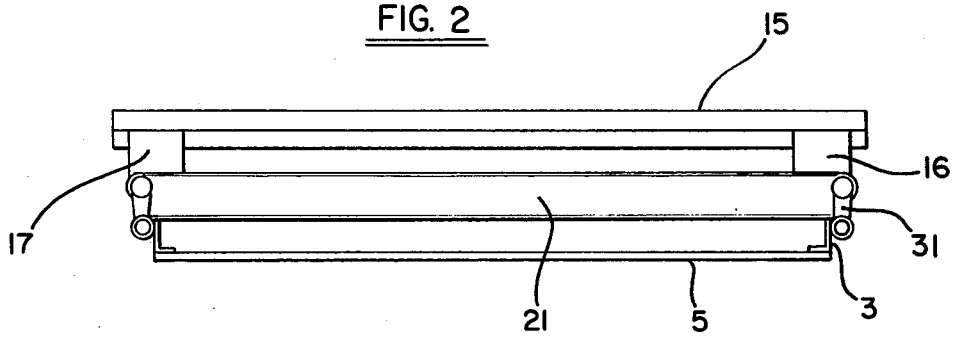
FIG. 2 shows a front elevation view of the workpiece supporting and clamping arrangement of FIG. 1.

Referring now to FIG. 1, the workpiece supporting and clamping assembly includes a supporting structure in the form of a rigid frame 1 including two spaced apart elongated frame members in the form of U-shaped beams 2 and 3. The beams 2 and 3 can be of any suitable section such as annular, L-shaped or U-shaped just to name a few. The U-shaped beams 2 and 3 are rigidly connected together by a further spaced apart pair of transverse frame members 4 and 5.

The workpiece supporting and clamping assembly of my invention shown in FIG. 1 is self-contained and as such is suitable for mounting on a work table. In such an application, the beams 4 and 5 are clamped to a table top.

The beams 2 and 3 are arranged so that respective legs 6 and 7 of the channels conjointly define surface support means on which the first and second top members 8 and 9 are supported. The top members 8 and 9 are clamping jaws having clamping surfaces 10 and 11, respectively. The first top member 8 has an upper surface 12 and is supported on the U-shaped beams 2 and 3 with the aid of spacer supports 13 and 14 as shown. The second top member 9 also has an upper surface 15. The second top member 9 is shown equipped with spacer supports 16 and 17 respectively, which support the second top member 9 on the respective horizontal flanges 6 and 7 of the beams 2 and 3 when the top member 9 is in the horizontal position shown in FIG. 3.

Guiding means in the form of a U-shaped bracket 18 guides the second top member 9 on the supporting structure 1. The legs 19 and 20 of the bracket 18 are interconnected by a front connecting piece 21 and are pivotally connected to the base of U-shaped beams 2 and 3 as will be shown below. When the guiding means is in the position shown in FIG. 3 a flange 21*a* of connecting piece 21 rests on the ends of the flanges 6 and 7 of the beams 3 and 2, respectively.

Although the spacer supports 13, 14, 16 and 17 are not necessary to the operation of the clamping arrangement, they are desirable because they increase the depth to which a workpiece can be inserted between the top members 8 and 9.

The second top member 9 is movable on the guide means and is mounted on the legs 19 and 20 which guide and hold the second top member. The legs 19 and 20 are essentially L-shaped and are pivotally connected by respective pivot pins 22 to corresponding ones of the beams 2 and 3 preferably at the longitudinal mid portions thereof. The second top member 9 is connected to the legs 19 and 20 so as to be movable therealong in the general manner shown, for example, in my copending United States patent application having Ser. No. 765,296 and filed on Feb. 3, 1977, now U.S. Pat. No. 4,155,386 under the title: Foldable Workbench. Thus, means are provided for moving the second top member 9 along the guiding means to adjust the position of the second top member 9 with respect to the first top member 8.

The moving means in the embodiment of my invention shown in FIGS. 1 to 11 includes first and second clamping means interconnected between the legs 19 and 20 and the top member 9 for moving the second top member 9 over the legs 19 and 20 in a direction toward or away from the first top member. One of the clamping means is shown in the exploded view of FIG. 6.

The clamping means includes the support 16 which is pivotally connected to the second top member 9 by means of a bolt 23. Detail views of the support 16 is shown in FIGS. 6A to 6C.

Figure 3:
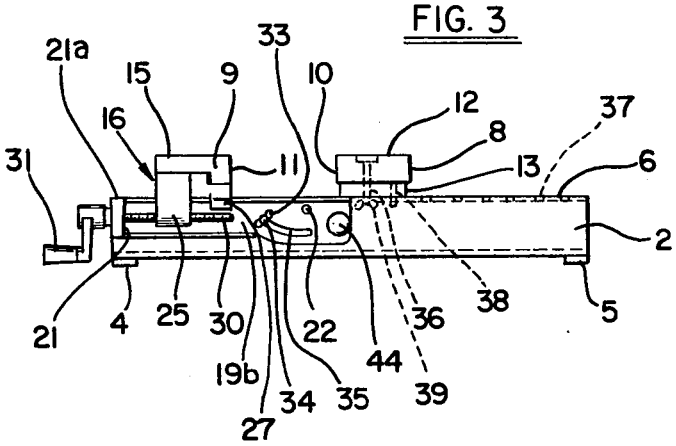
FIG. 3 is a side elevation view of the clamping arrangement of FIGS. 1 and 2 and shows the two clamping members mutually adjacent so that their respective upper surfaces lie in a common substantially horizontal plane.

As shown in FIG. 6A, the support 16 has a flat bottom surface 24 which rests on the horizontal flange 6 of beam 2 when the top member 9 is in the horizontal position shown in FIG. 3. A portion of the bottom surface 24 also rests on the holding leg 19. The support 16 also includes a first downwardly extending portion 25 which contains an internal thread 26. The internal thread 26 can be, for example, a nut trapped in the portion 25. FIG. 6B shows a section view of the support 16 at the line VIB—VIB of FIG. 6.

A second downwardly extending portion 27 of the support 16 (FIG. 6C) defines an open slot 28 for slideably engaging the horizontal flange 19*a* of holding leg 19.

The second top member 9 is translated along the holding legs 19 and 20 with the aid of threaded spindles 30 and the internal thread 26 threadably engaging the spindle. The spindle 30 is rotatably engaged in the front connecting piece 21 so that it cannot move axially with respect thereto. The spindle 30 is rotated with the aid of the crank handle 31. This action causes the support 16 to move along the flange 19*a* of the leg 19 thereby causing the second top member 9 to move toward or away from the first top member 8 depending upon the direction of rotation of the crank 31. The second downwardly extending portion 27 helps hold and guide the support 16 with respect to the leg 19. If only one of the cranks 31 is rotated then the top member 9 will be at an angle with respect to top member 8. By rotating both cranks 31 simultaneously, the top member 9 can be moved toward top member 8 so that the gap width therebetween is the same at both longitudinal ends of the gap.

Figure 4:
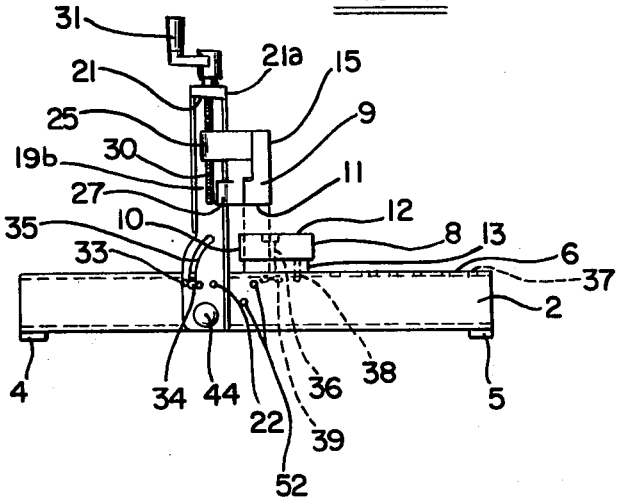
FIG. 4 shows how one top member can be rotated through an angle to a position 90° for clamping a workpiece against the upper surface of the other top member.

Means are provided for conjointly rotating the guiding means 18 and the second top member 9 from a position (FIG. 3) on the respective flanges 6 and 7 of beams 2 and 3 whereat the upper surfaces 12 and 15 are in a common horizontal plane to the position shown in FIG. 4 whereat the clamping surface 11 of the second top member 9 is adjacent this horizontal plane. The rotating means for achieving rotation of the guiding means and the second top member 9 includes the pivot pin 22 referred to above.

Figure 5:
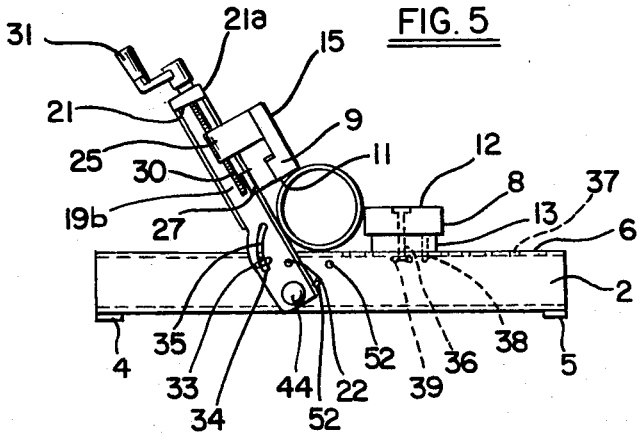
FIG. 5 shows how the rotatable top member can be adjusted to any selected angular position between the two positions shown in FIGS. 3 and 4 respectively, to clamp a workpiece such as a pipe section.

The guiding means and second top member 9 are adjustable to any selected angular position between the positions shown in FIGS. 3 and 4 such as the angular position shown in FIG. 5. In this angular position, the upper surface of the second top member 9 is in a plane transverse to the above-mentioned horizontal plane thereby causing the clamping surfaces 10 and 11 and the surface support means in the form of legs 6 and 7 to conjointly define a three point clamping system as shown in FIG. 5. For the positions shown in FIGS. 4 and 5, the second top member can be actuated and moved along the horizontal flanges of legs 19 and 20 as described above.

In the first position, the second top member 9 is supported on the beams 2 and 3 through the spacer supports 16 and 17 which rest on the respective horizontal flanges 6 and 7 of beams 2 and 3. In this condition the front connecting piece 21 is dripped onto beams 2 and 3 so that flange 21*a* rests on the horizontal legs 6 and 7 at the front ends thereof.

The holding legs 19 and 20 rotate about pins 22 to any desired position as explained above. However, it is desirable to provide locking means for locking the guiding means with respect to the supporting structure at a selected angular position. Referring to FIG. 6, the locking means can include a clamp in the form of a wing nut 33 threadably engaging a bolt 34 mounted on the beam 2. An arcuate slot 35 is formed in the holding leg 19 and the shank of bolt 34 passes through the slot. The arcuate slots 35 have a radius center at the location of pivot 32.

When the wing nut 33 is tightened, the leg is tightly held in position against the beam 2 fixing the guiding means in the desired position.

It will be recalled that the clamping arrangement of my invention can be utilized to clamp a workpiece down on the upper surface of the first top member 8. FIG. 4 shows the second top member 9 in the position to perform this clamping function with the clamping surface 11 in a horizontal plane above the upper surface 12 of the first top member 8. In this manner, a workpiece can be clamped in a suitable position between the clamping surface 11 and the upper surface 12.

When the movable top member 9 is moved toward the upper surface 12 of the first top member 8, the workpiece placed therebetween exerts a reaction force upon the second bench top member 9 at the clamping surface 11. This force acting in the upward direction develops a moment about the pivot pin 22 which tends to slide the second top member 9 off of the workpiece. The locking means performs the additional function of counteracting the effect of this turning moment by developing a counter balancing moment about the pivot pin 22.

It is often desirable to be able to position the first top member 8 along the surface support means. Positioning means can be provided for positioning the first top member 8 along the supporting structure to a selected position on the surface support means whereby the first top member 8 can be manually shifted and located laterally with respect to the second top member 9 to rapidly adjust the coarse width of the clamping gap between these top members to accommodate varying sizes of workpieces whereby the moving means can be manually adjusted to fine adjust the width of the gap to tightly hold the workpiece between the top members when the second top member 9 is in the first position shown in FIG. 3 and between the top members and the surface support means when the second top member is in the positions shown in FIGS. 5 and 6.

More specifically and referring now to FIG. 7, the first top member 8 can be indexed into a number of predetermined selected positions along the beams 2 and 3 and can be held in place by means of bolts 36 which are inserted into indexing means in the form of openings 37 in the horizontal flanges 6 and 7 of the beams 2 and 3. Locating pegs 38 cooperate with the bolts 36 and engage openings in the flanges 6 and 7 adjacent the openings into which the fastening bolts 36 are placed. The wing nut 39 is tightened to secure the first top member 8 in place.

If desired, other means can be utilized for positioning the first top member 8 along the beams 2 and 3. For example, a lever can be provided beneath the first top member 8 to engage and disengage the horizontal flange of the beams 2 and 3 and thereby eliminate the need for a bolt. Still other lever arrangements can be utilized wherein a lever is pressed to disengage pins from the indexing holes and reengage holes 37 in the beams 2 and 3 at a new location thereon.

It is also possible to provide for angular adjustment of the first top member 8 with respect to the second top member 9 so that the angularity achieved by adjusting the second top member 9 with the aid of the moving means can be augmented. To achieve this effect, the top member 8 can be pivotally connected to the support spacers 13 and 14.

Figure 9:
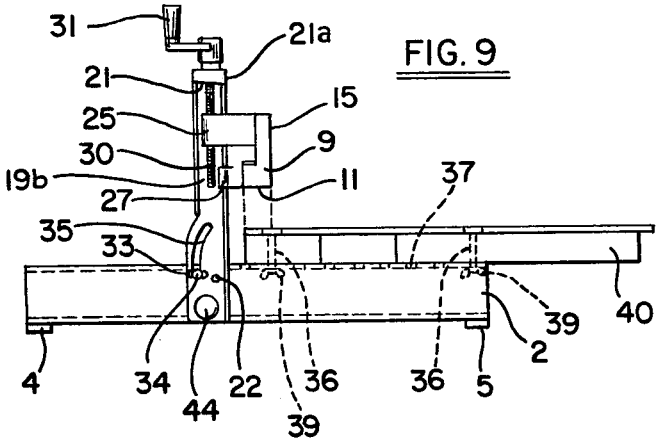
FIG. 9 illustrates the third top member repositioned to a different location on the supporting structure.

FIGS. 8 and 9 show how the first top member can be replaced by a top member 40 affording a greater work surface area to the operator.

Figure 10:
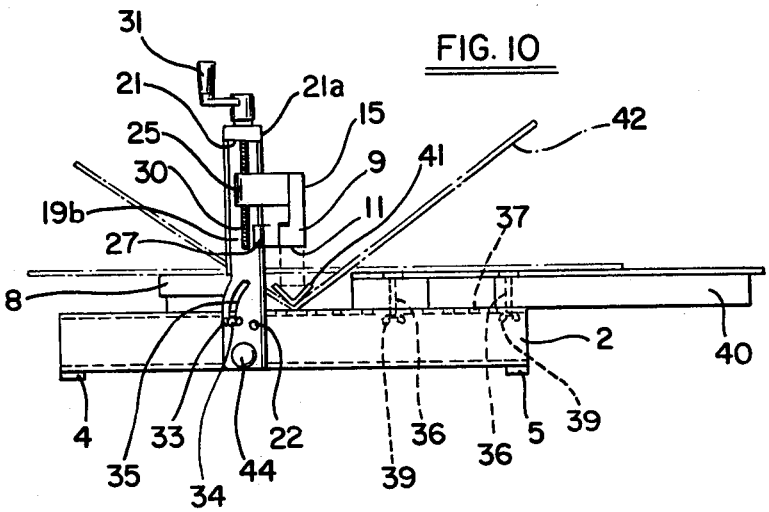
FIG. 10 illustrates how the clamping arrangement according to my invention can be used for shaping workpieces such as sheet metal.

FIG. 10 shows how the workpiece supporting and clamping arrangement of my invention can be utilized for shaping materials such as sheet-metal. In the embodiment shown, the clamping surface 11 is fitted with an angle section 41 for engaging the workpiece 42. The large area top member 40 constitutes a third top member and is supported on the surface support means defined by the supporting structure. Suitable means are provided for positioning the thid top member 40 along the surface support means. Such means can be the index means as discussed above in connection with FIG. 7. The first and third top members 8 and 40 are indexed so as to be spaced away from the plane defined by the upper surface 15 of the second top member 9 when the second top member 9 is in the vertical position as shown in FIG. 10. A workpiece 42 placed across the first and third top members is shaped when the moving means are actuated to move the second top member 9 along said guide means 17 downwardly on the workpiece.

Figure 11:
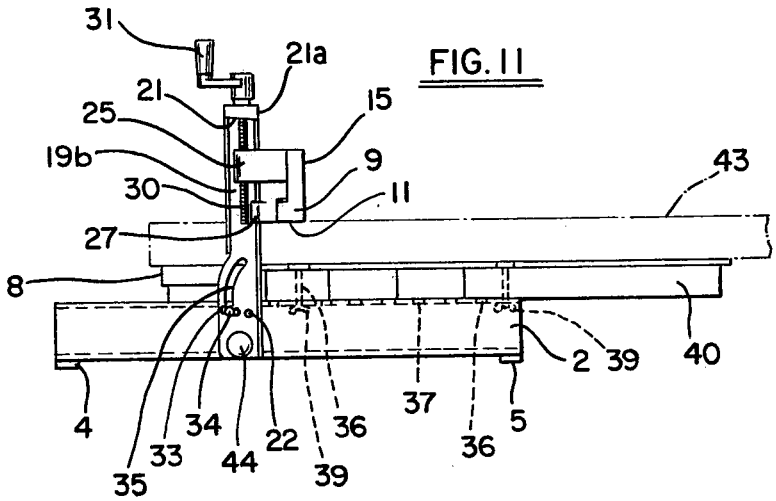
FIG. 11 is a view showing how the first top member and the third top member can be utilized to provide a greater bearing area for clamping a workpiece thereto with the aid of the rotatable top member.

FIG. 11 shows how the first top member 8 and third top member 40 can be placed close to each other to afford increased bearing support to a workpiece 43.

The locking means for locking the guiding means with respect to the supporting structure described above with reference to FIGS. 3 to 5 can be augmented to provide for an arrangement for fixing the angular position of the legs 19 and 20 at predetermined positions most often used, for example, 0°, 45° and 90° elevation. Accordingly, predetermined angular fixing means for fixing the angular position of the guiding means can be in the form of a locking knob assembly as shown in FIG. 12.

The locking knob assembly 44 includes a hat-shaped piece 45 having a rim 53 which is secured under tabs 46 formed from vertical flange **19*b*. The tabs 46 engage recesses 54 of the rim 53 to hold the hat-shaped piece 45 tightly to the flange 19*b* of leg 19. Cam surfaces 47 are formed on the piece 45 as shown in FIG. 13. A second cap-like piece 48 has corresponding cam surfaces 49 and is also shown in FIG. 13. Referring again to FIG. 12, a pin 50 is secured to the piece 48 and a spring 51 acts upon the pin to urge it into engagement with one of the openings 52 when the leg 19 is rotated therepast. Two of the openings 52 are visible in FIG. 4 and correspond to the respective positions 0° and 45°. For the position of the leg 19 shown in FIG. 4, the pin 50 is engaged with the opening 52** corresponding to the 90° position.

If it should be desired to disable the knob-assembly 44, then the piece 48 is rotated so that cams 49 ride upon cams 47 so as to lift the pin 50 clear of the beam 3 thereby compressing spring 51.

FIGS. 14 to 22 illustrate another embodiment of my invention which relates to a vise wherein only one spindle is utilized to move the rotatably mounted jaw toward the stationary jaw. This vise is especially suitable for mounting on top of a workbench or other such suitable location.

Figure 14:
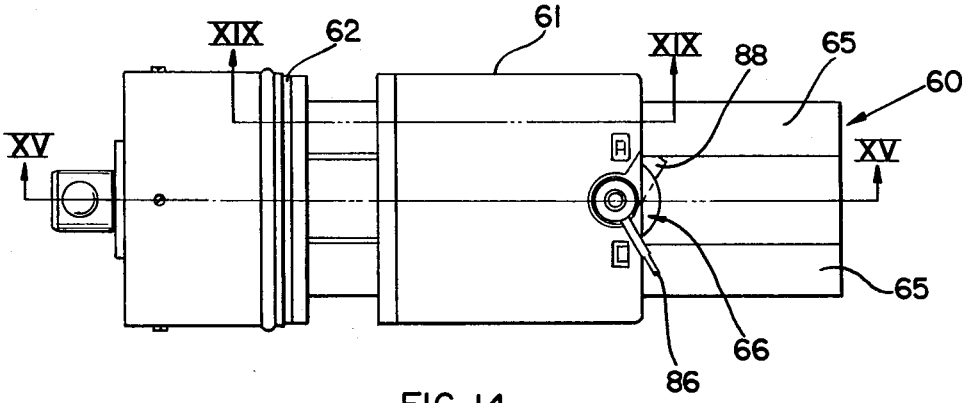
FIG. 14 is a plan view of an alternate embodiment of the clamping arrangement according to my invention wherein the clamping arrangement is in the form of a vise having a rotatable jaw actuated by one spindle.
Figure 15:
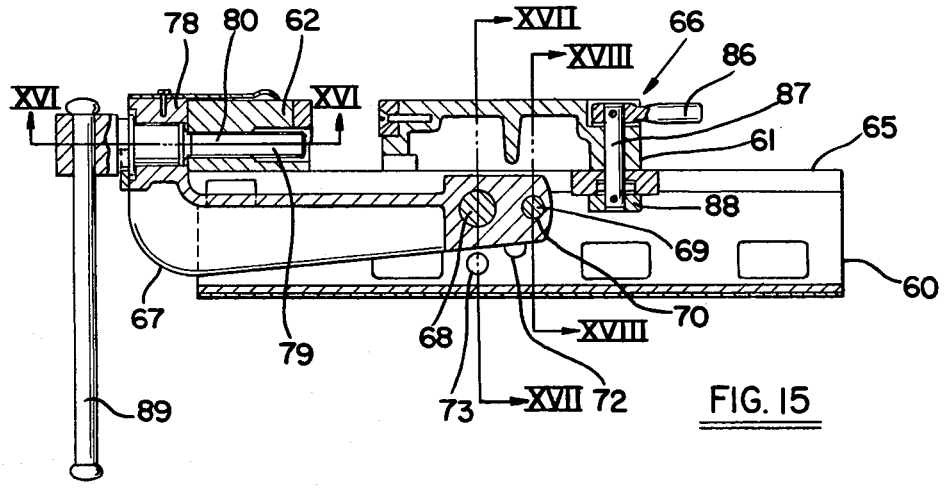
FIG. 15 is a side elevation view, in section, taken along the line XV—XV of FIG. 14.
Figure 18:
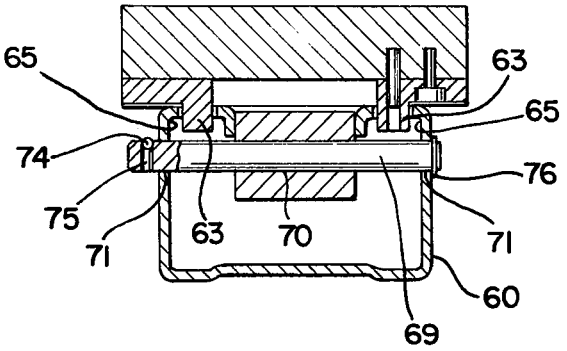
FIG. 18 is a section view taken along the line XVIII—XVIII of FIG. 15.
Figure 19:
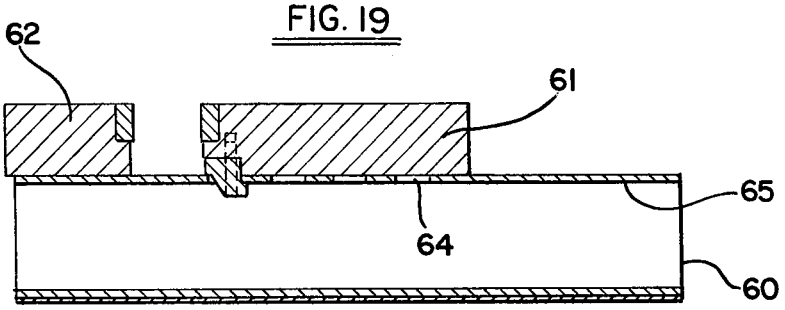
FIG. 19 is a section view taken along the line XIX—XIX of FIG. 14.

Referring to FIGS. 14 and 15, the vise is equipped with a base 60 which supports the stationary jaw 61 and the movable jaw 62. The stationary jaw 61 has a rib-like configuration and can be mounted on the base 60 in various positions with respect to the second jaw by means of retainer teeth 63 (FIGS. 18 and 19). The teeth 63 corresponding openings 64 in guide rails 65 of the base 60. Once the stationary jaw 61 has been indexed to a desired location, it is fixed in place by means of a clamp indicated generally by reference numeral 66. The clamp can be of any suitable type which will serve to secure the stationary jaw 61 to the guide rails 65 of the base 60. In the clamp 66 shown, the lever 86 rotates a connecting rod 87 for rotatably actuating a bar 88 which engages the underside of guide rails 65 to secure the jaw 61 in its indexed position.

The second jaw 62 is carried by an arm 67 which is pivotally mounted to the base 60 and can be rotated to various angular positions with respect to the base 60 and the first jaw 61. The arm 67 is longitudinally arranged between the guide rails 65 of the base 60 and is mounted for rotation at pin 68 which extends between the mutually adjacent walls of base 60. The arm 67 can be locked in various angular positions on the base 60 by means of a locking pin 69 passed through the bore 70 of the arm 67. The pin 69 can be locked in any one of the bore openings 71, 72 or 73 in the wall of the base 60. For each of the bore openings 71 to 73, a pair of corresponding in line through bore openings are provided in the base 60 as shown in FIG. 18 for the bore openings 71. The other bore openings 72 and 73 are also provided and are at different angular positions as shown in FIG. 15 so that the locking pin is held in both walls of base 60. The three pairs of bore openings 71, 72 and 73 all have their centers on an arc having its radius center on the axis of rotation of the pin 68. When it is desired to place the arm 67 at a desired angle, the arm 67 is rotated about the pin 68 so that its bore 70 lines up with the bore pair corresponding to the desired angular position. Then the pin 69 is inserted through the coaxial holes of the arm and the bore openings in the walls of the base 60.

The locking pin 69 is provided with a sphere 74 spring loaded by means of a spring 75 to slightly project the ball beyond the surface of the pin. The sphere 74 and an elastic check ring 76 are at respective opposite ends of the pin 69 and prevent the latter from slipping out of its bores when the vise is in use. The movable jaw 62 is carried by guide pins 77 (FIG. 16) which extend from the head 78 of the arm 67. The jaw 62 moves along pins 77 parallel to the arm 67.

Figure 16:
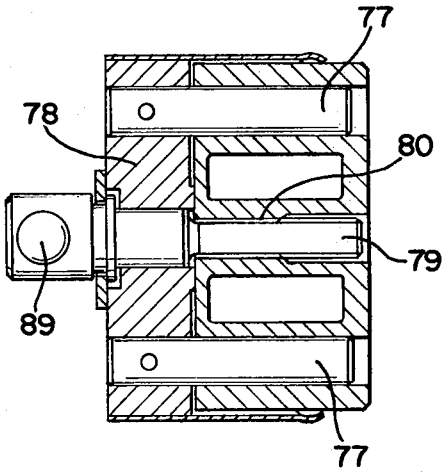
FIG. 16 is a section view taken along line XVI—XVI of FIG. 15.
Figure 17:
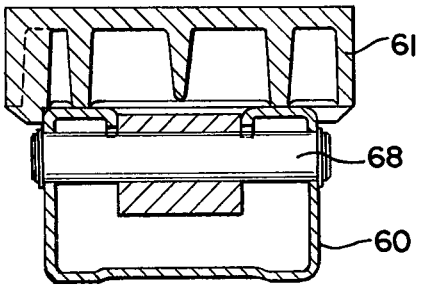
FIG. 17 is a section view taken along the line XVII—XVII of FIG. 15.
Figure 20:
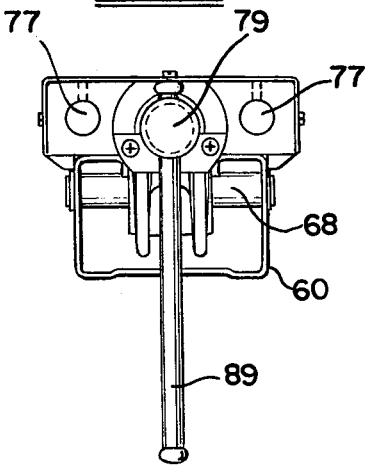
FIG. 20 is a front elevation view of the vise shown in FIG. 15.
Figure 21:
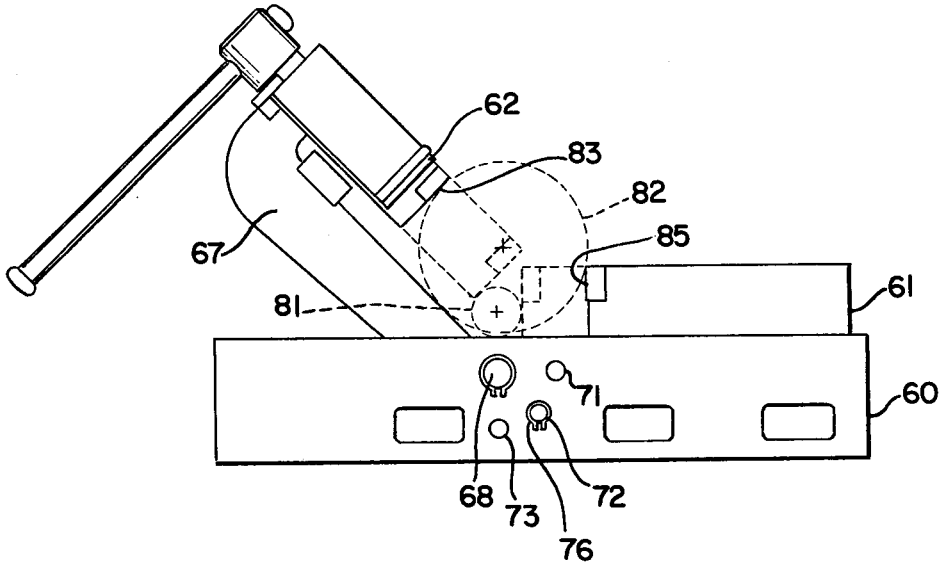
FIG. 21 is an elevation view of the vise showing the arm positioned at an angle so that the vise may hold a workpiece such as a pipe section.

The jaw 62 is moved along the arm 67 by means of a spindle arrangement (FIGS. 15, 16 and 20). The spindle arrangement includes a threaded spindle 79 which engages an internal thread 80 in the movable jaw 62. The spindle 79 is manually rotated with the aid of the rod 89 to move the jaw 62. When the arm 67 is raised to the angular position as shown in FIG. 21, a three point clamping system is defined wherein the clamping jaws and either the base 60 or the arm 67 conjointly define a three point clamping system depending upon the size of the workpiece. This position is especially convenient for holding a workpiece such as a pipe conduit. The workpiece 81 in FIG. 21 is held between the base 60 and the jaws 61 and 62; whereas, the larger workpiece 82 is held between the arm 67 and the jaws 61 and 62. In both situations, the vise according to my invention defines a three point clamping system.

Figure 22:
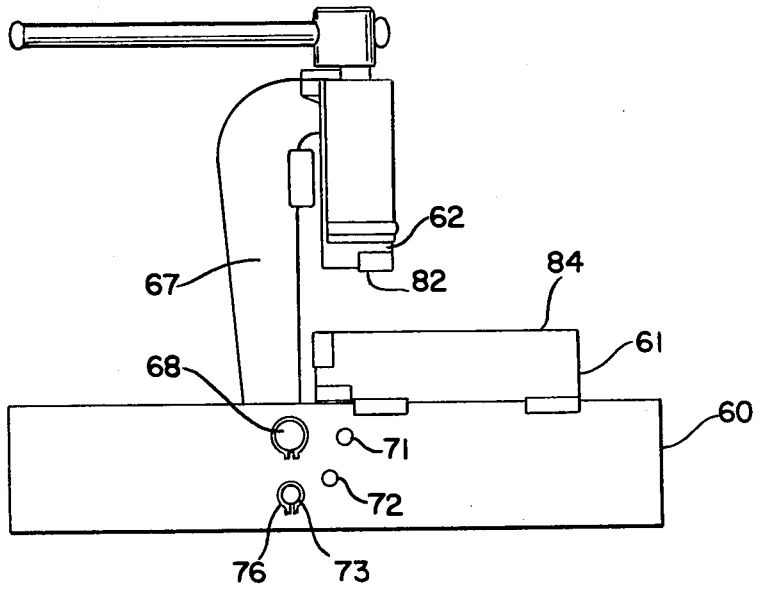
FIG. 22 is an elevation view showing how the arm can be rotated 90° for clamping a workpiece to the top of the stationary jaw.

In FIG. 22, the arm 67 has been rotated 90° so that a workpiece can be clamped between the clamping surface 83 of jaw 62 and a horizontal clamping surface 84 of the jaw 61.

From the foregoing, it becomes manifest that the clamping arrangement and vise according to my invention affords great flexibility and affords the operator the advantage of being able to perform clamping operations with a single vise which heretofore required at least two different clamping devices.

The vise according to my invention can be used as shown in FIG. 15 with the clamping surfaces of the jaws contained in vertical mutually parallel planes or, as shown in FIG. 22 with the clamping surface of the movable jaw 62 parallel to the upper surface 84 of the indexable stationary jaw 61. In addition, as shown in FIG. 21, the vise according to the invention enables the operator to bring the clamping surfaces 83 and 85 of the jaws into a condition wherein they are in nonparallel planes to conjointly define a three point clamping system with either the base 60 or the arm 67.

What I claim is:

1. A workpiece supporting and clamping arrangement comprising:

a supporting structure defining surface support means;

a first elongated top member having an upper surface and being supported by said supporting structure on said surface support means;

a second elongated top member having an upper surface, said upper surfaces lying in a common substantially horizontal plane;

said elongated top members having respective mutually adjacent side walls defining clamping surfaces;

a guiding structure mounted on said supporting structure for carrying and guiding said second elongated top member relative to said supporting structure;

means arranged on said guiding structure for linearly moving said second top member along said guiding structure so as to adjust the position of said second elongated top member with respect to said first elongated top member; and, pivot means pivotally connecting said guiding structure to said supporting structure so as to permit said guiding structure and said second elongated top member to be pivotally rotated from a first position on said surface support means whereat said upper surfaces are in said horizontal plane to a second position whereat said second top member is in a plane transverse to said horizontal plane so as to cause said clamping surfaces and said surface support means to conjointly define a three point clamping system.

2. The workpiece supporting and clamping arrangement of claim 1, said guiding means being rotatable to a third position whereat said clamping surface of said second member is substantially parallel to said horizontal plane.

3. The workpiece supporting and clamping assembly of claim 2 comprising: locking assembly means for fixing the angular position of said guiding means at predetermined angular positions with respect to said supporting structure.

4. The workpiece supporting and clamping assembly of claim 1, said rotating means comprising pivot means pivotally connecting said guiding means to said supporting structure; and, locking means for locking said guiding means with respect to said support structure at said second position.

5. The workpiece supporting and clamping assembly of claim 4 comprising: locking assembly means for fixing the angular position of said guiding means at predetermined angular positions with respect to said supporting structure.

6. The workpiece supporting and clamping assembly of claim 4 comprising:

means for positioning said first top member along said supporting structure to a selected position on said surface support means whereby said first top member can be manually shifted and located laterally with respect to said second top member to rapidly adjust the coarse width of the clamping gap between said top members to accommodate varying sizes of workpieces whereby said moving means can be manually adjusted to fine adjust said width of said gap to tightly hold the workpiece between said top members when said second top member is in said first position and between said top members and said surface support means when said second top member is in said second position.

7. The workpiece supporting and clamping assembly of claim 6, said positioning means comprising:

indexing means formed in said supporting structure for indexing said first top member along said supporting structure to any one of a plurality of selected index positions relative to said second top member; and, disengageable positive securing means for coacting with said index means to positively secure said first top member to said supporting structure at any one of said index positions.

8. The workpiece supporting and clamping arrangement of claim 6, said first and second top members each being elongated members.

9. The workpiece supporting and clamping arrangement of claim 6, said second top member being an elongated member, and said first top member having a longitudinal dimension corresponding to the longitudinal dimension of said second top member and a lateral dimension substantially greater than the lateral dimension of said second top member.

10. The workpiece supporting and clamping assembly of claim 4, said guide means being a bracket pivotally connected to said supporting structure by said pivot means whereby said bracket and said second top member can be rotated between said two positions.

11. The workpiece supporting and clamping assembly of claim 10, said bracket being a U-shaped bracket having a base and respective legs connected to said base, said legs being pivotally connected to said supporting structure.

12. The workpiece supporting and clamping assembly of claim 11, said support structure comprising a generally rigid base frame including a spaced apart pair of elongated frame members conjointly defining said surface support means, said legs being pivotally connected to respective ones of said frame members.

13. The workpiece supporting and clamping arrangement of claim 12, said legs being pivotally connected to said frame members at the mid portions thereof.

14. The workpiece supporting and clamping arrangement of claim 12, said base of said U-shaped bracket having a flange, said flange of said base being mounted on said legs so as to engage said frame members when said second top member is in said first position.

15. The workpiece supporting and clamping assembly of claim 10, said moving means comprising: first and second clamping means interconnected between said guiding means and said second top member for moving said second top member over said guide means in a direction toward or away from said first top member for tightly holding a workpiece between said top members when said second top member is in said first position and between said top members and said surface support means when said second top member is at said second position, said first clamping means and said second clamping means being connected to said guide means and said second top member so as to be capable of being operated independently of each other whereby the width of the clamping gap between said top members can be adjusted to be greater at one longitudinal end of the gap than at the other longitudinal end of the gap.

16. The workpiece supporting and clamping assembly of claim 15 comprising: means for angularly adjusting the first top member with respect to the second top member.

17. The workpiece supporting and clamping assembly of claim 4, comprising: a third top member supported on said surface support means and having an upper surface in said common horizontal plane; and, means for positioning said third top member along said surface support means to a selected position thereon spaced from said first top member, said first and third top members being spaced away from the plane defined by said upper surface of said second top member when said second top member is in said second position whereby a workpiece placed across said first and third top members is shaped when said moving means are actuated to move said second top member along said guide means toward said common horizontal plane to engage the workpiece.

18. A vise for clamping a workpiece comprising:

a base;

a first jaw supported by said base;

a second jaw, said jaws having respective mutually adjacent clamping surface;

a guiding structure mounted on said base for carrying and guiding said second jaw relative to said base;

means arranged on said guiding structure for linearly moving said second jaw along said guiding structure so as to adjust the position of said second jaw with respect to said first jaw; and, pivot means pivotally connecting said guiding structure to said base so as to permit said guiding structure and said second jaw to be pivotally rotated through an angle from a first position whereat said clamping surfaces conjointly define a two point clamping system to a second position whereat said clamping surfaces and said base conjointly define a three point clamping system.

19. The vise of claim 18, said first jaw having a second clamping surface substantially parallel to said base, said guiding means being rotatable to a third position whereat said clamping surface of said second jaw and said second clamping surface of said first jaw conjointly define a two point clamping system.

20. The vise of claim 19, said clamping surfaces of said first jaw being located at ninety degrees with respect to each other.

21. The vise of claim 18, said guide means comprising a holding arm connected to said base, and said rotating means comprising a pivot pin pivotally connecting said holding arm to said base.

22. The vise of claim 21, said base having a substantially U-shaped section for receiving said holding arm therein, said holding arm being pivotally connected to said base so as to cause said arm to extend longitudinally in said base when said guide means is in said first position.

23. The vise of claim 21 comprising: locking means for locking said holding arm at a number of predetermined angular positions relative to said base.

24. The vise of claim 23 comprising: means for positioning said first jaw along said base to any of a plurality of selected positions on said base spaced away from said second jaw whereby said first jaw can be manually shifted and located laterally with respect to said second jaw to rapidly adjust the coarse width of the clamping gap between said jaws to accommodate varying sizes of workpieces whereby said moving means can be manually adjusted to fine adjust said width of said gap to tightly hold the workpiece between said jaws when said second jaw is in said first position and between said jaws and said base when said second jaw is in said second position.

25. The vise of claim 24 comprising: locking means for locking said first jaw to said base at said selected position.

26. The vise of claim 23, said locking means for locking said holding arm comprising: bore means formed in said base; a bore formed and located in said holding arm so as to be in coaxial alignment with said bore means when said holding arm is rotated to any one of said predetermined angular positions; and, a pin insertable into said bore and said bore means when said holding arm is rotated to a selected one of said angular positions.

27. The vise of claim 18, said moving means comprising: a threaded spindle rotatably mounted on said guiding means; and, an internal thread formed in said second jaw threadably engaging said threaded spindle.

28. A vise for clamping a workpiece comprising:

a base;

a first jaw supported by said base;

a second jaw, said jaws having respective mutually adjacent clamping surfaces;

a holding arm connected to said base for holding and guiding said second jaw relative to said base;

means for moving said second jaw along said holding arm so as to adjust the position of said second jaw with respect to said first jaw; and, pivot means pivotally connecting said holding arm to said base so as to permit said holding arm and said second jaw to be conjointly rotated through an angle from a first position whereat said clamping surfaces conjointly define a two point clamping system to a second position whereat said clamping surfaces and said arm conjointly define a three point clamping system.

* * * * *